United States Patent [19]

von Braunhut

[11] Patent Number: 5,014,996

[45] **Date of Patent: * May 14, 1991**

[54] WORD CARD GAME

[76] Inventor: Harold von Braunhut, P.O. Box 809, Bryans Road, Md. 20616

[ * ] Notice: The portion of the term of this patent subsequent to Oct. 31, 2006 has been disclaimed.

[21] Appl. No.: 409,105

[22] Filed: Oct. 6, 1989

Related U.S. Application Data

[62] Division of Ser. No. 183,645, Apr. 19, 1988, Pat. No. 4,877,255.

[51] Int. Cl.[5] ..... A63F 1/04

[52] U.S. Cl. ..... 273/299; 273/150

[58] Field of Search ..... 273/148 A, 299, 304, 273/305, 309, 272, 150

[56] References Cited

U.S. PATENT DOCUMENTS

| | | | |
|---|---|---|---|
| D. 212,239 | 9/1968 | Schick | 273/152 |
| 848,042 | 3/1907 | Musgrave | 273/148 A |
| 4,003,577 | 1/1977 | Bolach | 273/148 A |
| 4,014,548 | 3/1977 | Trilling | 273/272 |
| 4,184,684 | 1/1980 | Cramer | 273/148 A |
| 4,384,722 | 5/1983 | Higgins | 273/272 |
| 4,690,409 | 9/1987 | Scalia | 273/299 |

FOREIGN PATENT DOCUMENTS

| | | | |
|---|---|---|---|
| 1273490 | 5/1972 | United Kingdom | 273/304 |

*Primary Examiner*—Edward M. Coven
*Assistant Examiner*—Sebastiano Passaniti
*Attorney, Agent, or Firm*—Helfgott & Karas

[57] ABSTRACT

A game utilizing a deck of playing cards. The playing cards each have letter designations in the upper left hand corner in each of two different invertible positions of the card with the letter designation differing from each other. In the lower right hand corner of each of the two invertible positions of the card, there is provided an "information center" giving the letter designation of the card should the card be inverted. Thus, as the cards are held in a hand, one adjacent to the other, both the letter designating the card in its upright position as well as the letter available to the card, should the card be inverted, are both visible to the player. Cards are selected and a word must be formed with the cards being able to be positioned in either of their two inverted positions. After the word is formed, the word is then used as an acronym in the formation of a sentence, with the sentence preferably being associated with the word itself.

9 Claims, 2 Drawing Sheets

WORD CARD GAME

This is a division of application Ser. No. 183,645, filed Apr. 19, 1988, now U.S. Pat. No. 4,877,255.

BACKGROUND OF THE INVENTION

This invention relates to a card game, and more particularly to a game utilizing a deck of cards wherein words are formed from the cards, after which the words are used as acronyms for the formation of sentences, preferably relating to the words formed.

Numerous playing games are readily available which utilize the skill and imagination of players. More recently, word games have become popular utilizing the word skills of the players. Such games are both challenging, provide enjoyment, and at the same time, have an educational flavor since they require the imagination of the player, utilizing his capability of word knowledge.

Most of the word games available are board type games utilizing letters on the board or on playing pieces or blocks placed on the board. When using playing pieces, these playing pieces are put together to form words on the board. While such type of game also utilizes skill and creativity in creating words, because of their requirement in utilizing a board and playing pieces, the game becomes bulky requiring a considerable number of pieces and parts which must be carried around before the game can be played.

One type of game that has not at all been addressed is a game based upon acronyms. Acronyms are words whose letters form the first letter of each word in a sentence or phrase and are usually suggestive of the acronym itself. While word games are available, a game utilizing a word as an acronym has not yet been available.

Additionally, with typical playing cards, the card has only a single designation. Normally, this is because when the card is held in an upright position, only the upper left hand corner is visible. Thus, any designation provided to the cards appear in the upper left hand corner and visible as the cards are fanned. Although other parts of the cards might be visible, no use is made of such other parts of the cards since when held in the fanned position, normally only the upper left hand corner is visible and thus, this corner provides for the designation of the card. Since cards may typically be inverted, both upper left hand corners in each of the two inverted positions of the card are usually identical and provide for the same designation of the card.

SUMMARY OF THE INVENTION

Accordingly, it is an object of the present invention to provide a new and improved card game utilizing a deck of cards for forming words from the cards.

Another object of the present invention is to provide a word game wherein the words are formed using individual cards of a deck of playing cards held in the hand of the player.

Still another object of the present invention is to provide a game based upon the use of acronyms in creating a sentence of words related to the acronym.

Yet another object of the present invention is to provide a deck of playing cards with each card having two designations corresponding to each of the two inverted positions of the card.

Another object of the present invention is to provide a deck of playing cards with each card having two designations in each of two orientations of the card, as well as providing an indication in each of the orientations of the designation which will occur when the card is inverted.

Still another object of the present invention is to provide a deck of playing card with each playing card having two designations in each of the two inverted positions in which the playing card can be held, with a single point value for the card regardless of which designation is being utilized.

Briefly, in accordance with the present invention, there is provided a deck of playing cards having a plurality of individual cards. Each of the cards include a front and back surface. On the front of the surface there is provided a first designation in the upper left corner of the card. When the card is inverted, in the opposite direction, there is provided a second designation to the card in the upper left hand corner of the inverted card. Thus, the card has two designations based upon which of the two inverted positions of the card it is held in. The two designations thereby being in a first pair of opposing diagonal corners.

The other pair of opposing diagonal corners are used for indicators of the inverted designation. Thus, with the card held in a first orientation, the designation of the card in that orientation is provided in the upper left hand corner and in the lower left hand corner, there is provided an indicator of the opposite designation. Likewise, when the card is inverted, in the inverted position in the upper left hand corner there is provided an indication of the second designation and in the lower left hand corner, there is provided an indication of the first designation should the card be re-inverted to its first position.

The cards are utilized in connection with a word game wherein a plurality of cards are selected by each player and the cards thus selected are utilized to form a word. The cards can be placed in each of their two inverted positions whereby each card has two designations which can be utilized. The designations are letters and the letters are combined by the player into the formation of a word. Each card has a single point value and the point values are added to provide a cumulative score for the word formed.

In an embodiment of the invention, after the word is formed by the player, the player then takes that word and utilizes it as an acronym in the formation of a sentence. Preferably, the sentence should have some association with the word itself.

The game includes a central playing surface such as a pad on which the deck of cards can be placed in selected piles. Each player, likewise, has a playing surface on which he can place his selected cards. There are also provided card holders for storing cards that have been already utilized in the formation of words. Score sheets are provided for counting the cumulative point score, as well as writing the sentence formed from the acronym word. There can also be included a timer in order to provide a time limit for making the word and/or for creating the sentence using the word as the acronym.

The aforementioned objects features an advantage of the invention that will, in part, be pointed out with particularity, and will, in part, become obvious from the following more detailed description of the invention. Taken in conjunction with the accompanying drawings, which form an integral part thereof.

BRIEF DESCRIPTION OF THE DRAWINGS

In the drawings.

In the various figures of the drawing, likewise, print characters designate like parts.

DESCRIPTION OF THE PREFERRED EMBODIMENT

Figure 1:
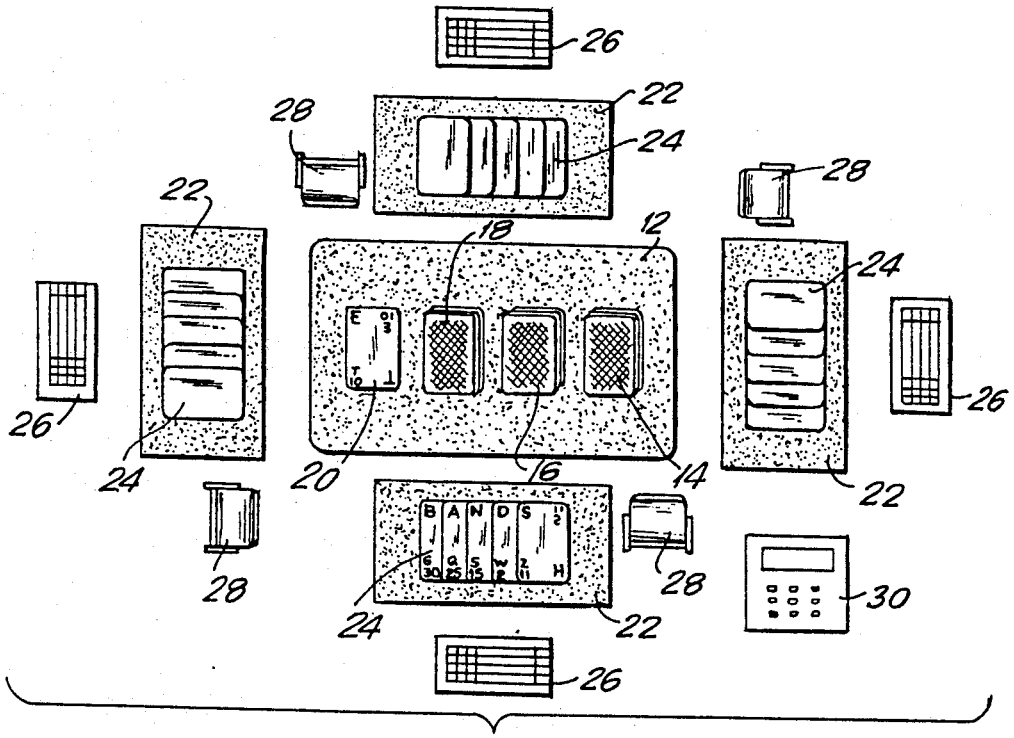
FIG. 1 is an overall schematic view of the various parts of the game of the present invention.

Referring now to FIG. 1, the various elements of the present invention are shown and include a central playing surface 12 which can typically be a felt pad, or the like, large enough to hold four piles of cards. A deck of playing cards in use in the present invention is divided up into three piles 14, 16, 18 having their back surfaces facing up. The back surfaces of the cards can have any type of decorative design to enhance the interest and aesthetic nature of the deck of cards. A fourth pile 20 is provided as the discard pile and is provided with the front face up. Such front face contain indicia as will be hereinafter described in more detail.

For each player, there is provided a small playing surface 22, which can also be a felt pad. On such surface, there is adequate room for the placement of at least five playing cards in a group spread apart such that letters of each card can be viewed in the upper left hand corner of the card and the cards placed spread out on the surface 22 to read the word formed by the cards, as shown at 24. Also provided are individual score sheets 26 for each player. The score sheets will be described hereinafter in more detail.

A card holder 28, to be hereinafter described in more detail is available for placement of the cards that were already used in the formation of a word where they can be stored until completion of the game. After completion of the game, they will all be re-united to form the deck of cards for subsequent use in the next game.

A timer 30 can also be included for timing the amount of time that a player has to form a word. The timer can also be used to time the length of time that he has to form a sentence using the word as an acronym, as will hereinafter be described. Any such timer can be utilized, including an electric timer, an egg timer, etc.

A unique aspect of the present invention is the particular type of cards utilized. The cards generally have a front and back face. The back face includes a pictorial design and all cards in the deck have the same pictorial design so that from the back all the cards appear identical and one cannot tell the cards from each other. However, the front face of the cards are the side that contain the necessary indicia designating the particular card. Normally, when a hand of two or more cards are held in a standard deck, and the cards are spread apart from left to right, the right hand corner of the card is invisible since it is hidden behind the card in front of it. Only on the extreme right hand card, referred to as the top card, can all four corners be read. However, for all other cards held in the hand, only the upper left hand corner can be read. The upper right hand corner is normally covered and, therefore, is generally unprinted.

Since it is only the upper left hand corner that can be seen when the cards are held in a hand, that is normally the only corner that is printed. However, a playing card can often be held in either of its two inverted positions. In either such position, however, it is only the upper left hand corner of the particular card that will be visible. Accordingly, it is only a first pair of opposing diagonal corners that are the useful corners on a card. While occasionally, the card may maintain a printed designation in all four corners, the designation in the upper right hand corners in both of the inverted positions are useless since they are always covered regardless of the position that the card is held in.

Figure 2:
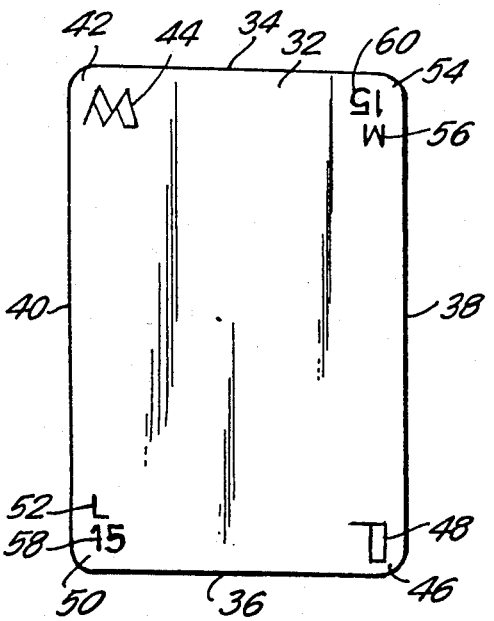
FIG. 2 is a view of the front face of one of the cards, typical of the cards in the deck of playing cards.

Referring now to FIG. 2, it will be seen that the playing cards in the present game make use of the right hand corners which are normally useless. Furthermore, it provides two designations to the cards rather than the single designation normally utilized for an individual card.

More specifically, a card 32 is shown with the front face thereof being visible. The card is of substantially rectangular shape, having opposing short sides 34, 36 interconnected by long sides 38, 40. The card can be held in either of two orientations with either the short side 34 in the up position or the short side 36 in the up position. As shown in FIG. 2, the short side 34 is in the up position.

When held as shown in FIG. 2, the upper left hand corner 42 would generally be visible as a hand of two or more cards are spread from left to right. In that corner, there is provided a designation of the card 44. Such designation is shown to be an alphabetic letter, and in this particular case the letter "M". Thus, when the card is held with the short side 34 in the up position, the card is designated as a card useful in providing the letter "M".

If one were to envision that the card would be inverted with the short side 36 placed in the upward position, the corner 46 would then be the upper left hand corner. In that case, a second designation 48 is provided. In this case, again an alphabetic letter is utilized and in the particular example shown, the letter "L" is utilized. Thus, if the card would be inverted so that the side 36 is up, the card would be useful to provide the letter "L" in forming a word.

It should thus be appreciated that the card has two possible designations rather than the normal single designation of a card. However, in addition to utilizing the two designations in the opposing diagonal upper left hand corners 42, 46, the opposing right hand corners, which are normally covered, are also provided for use. Specifically, when a hand of two or more cards are held, and the upper left hand corner is visible, the complete right side is covered by the next card on top of it. However, the lower left hand corner could be visible by slightly moving the cards apart. In the present card, such lower left hand corners are utilized as an information corner providing information to the player of what the designation of the card would be if the card would be inverted.

Specifically, with the card held in the orientation shown in FIG. 2 with the short side 34 in the up position, the card is an "M" letter card. If the card would be inverted, it would be an "L" letter card. However, when another card is placed on top of the card shown in FIG. 2, that designation of the letter "L" in the lower right hand corner is covered by the next card on top of it. For this reason, the lower left hand corner 50, which is used as the information corner, contains a designation 52 which corresponds to the designation 48 if the card would be inverted. Specifically, the designation is a letter "L".

Accordingly, when the user holds the card in the first designation as an "M" card, he can look at the bottom and see the letter "L" in the information corner advising the user that if he inverts the card, he would be able to use the card as an "L" card.

In a similar manner, if one were to imagine the card in FIG. 2 inverted with the short side 36 in the up position, the corner 54 would then be in the lower left hand location and, again, in that information corner, there is provided a designation 56 corresponding to the designation that would be in the inverted position. In this case, a letter "M" is placed in the information corner 54.

It should be appreciated that in order to make the letters readable, the letters on the long side 40 are both in the upright position, and the letters along the long side 38, are both in the inverted position. This permits reading both the letter on the top corner of the side 40 and the bottom corner of the side 40 when the card is held in the orientation with the short side 34 up. Likewise, both the letter 48 and the letter 56 would be readable when the card would be held in the inverted position with the short side 36 up.

As a result, it is noted that along the top, the letter "M" in the upper left hand corner 42 and its letter "M" on the right hand side 54 are upside down with respect to each other. Likewise, the two letters "L" in the corners 50 and 46 are upside down with respect to each other.

In order to distinguish the actual letter designating the card from the letter in the information corner, the two letters can either be made of different sizes or different colors. Specifically, the main letters 44 and 48 are made larger in the embodiment shown and the information letters 52 and 56 are made smaller.

In addition to the two designation letters on the card, the particular card has a point value. The point value, however, does not change with each of the two designations. Accordingly, whether the card is used as an "M" card or as an "L" card, it has the same point values. In the present situation in FIG. 2, the point value of the card is 15 points. Such value is shown by the designation 58 provided in the information corner 50 and, likewise, by the designation 60 provided in the information corner 54. Should it be desired, the point value can be made in a different color than the letter designations of the cards.

Figure 3:
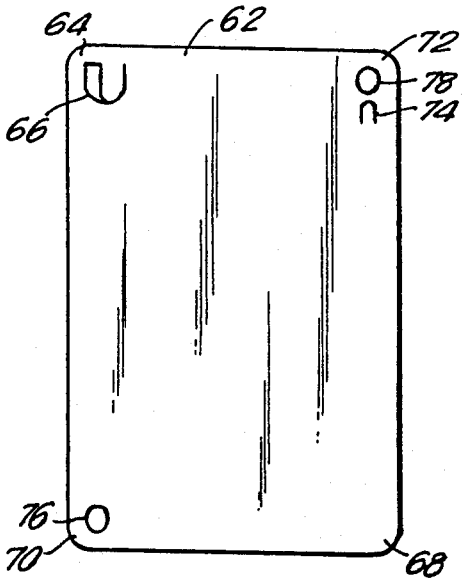
FIG. 3 is the front view of one of the special cards of a small group of special cards within the playing deck.

In addition to the card shown in FIG. 2, a certain group of select cards can be utilized as "zero value" or "wild" cards. Such a card is shown in FIG. 3 as card 62. The card shown in FIG. 2 as "zero value" or "wild" cards can be used when particular letters are missing to make up a word and these cards can be used to provide any letter needed by the player in order to complete a word. In the card as shown, in one corner 64 a vowel 66 is shown, in this case as the vowel "U". However, in the other corner 68 which would normally contain another designation, no designation is shown indicating that the card can be used for any letter of the alphabet that is needed by the player to complete a word.

In the information corner 70, there is no letter provided since the letter in the inverted designation is missing at the corner 68. However, since a vowel "U" is shown in the corner 64, and the corresponding information 72, there is provided a letter "U" at 74.

The point value of the card is, as previously indicated "zero" and such is shown in both information corners 70 and 72 as the numeric designations 76 and 78. In order to distinguish the point value zero from the corresponding letter "0" in the alphabet, different colors or different printing styles can be utilized, as indicated.

Figure 4:
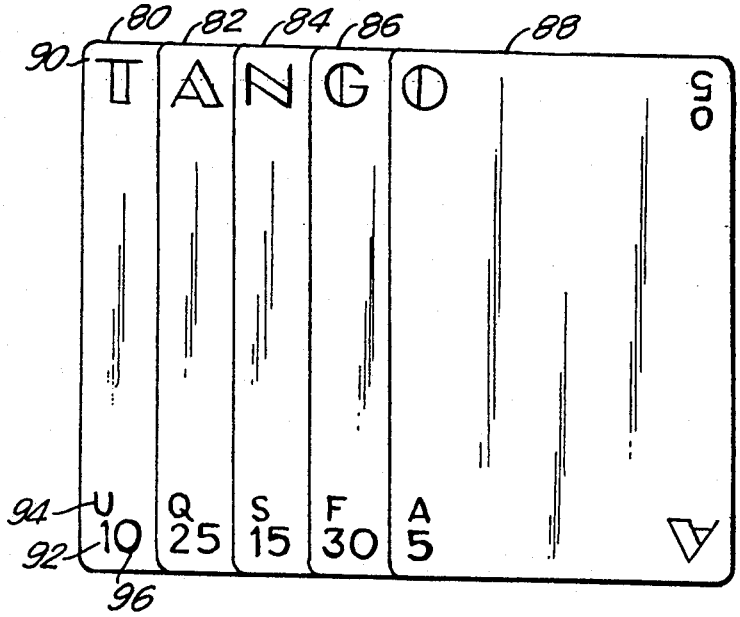
FIG. 4 is a front view of a group of cards held together to form a word in accordance with the game of the present invention.

Refer now to FIG. 4, a group of five cards held in a hand are shown put together to form the word "TANGO". As is evident, the five cards so, 82, 84, 86, and 88 are placed one on top of the other with the top most card 88 being the only card in which all four corners are visible. On the other four cards, however, only the upper left hand corner is visible. In this case, the cards are slightly spread to provide substantially parallel edges rather than the usual "fan" arrangement, so the lower corners are also visible. Thus, on the first card so although the upper letter "T" in the corner 90 is being utilized, the player can look at the bottom in the corner 92 and note that the letter "U" indicated at 94 would be available on that card if the card 80 were inverted. Of course, the card 80 has a point value of ten, as is indicated by the designation 96.

Accordingly, the first card so has two available designations. The one that is being utilized is the letter "T". However, it is also available to be used as a "U" card. Likewise, each of the other cards is being utilized for a particular letter. However, at the bottom there is provided in the information corner the letter that would be available if the card would be turned over. There is also provided the point value.

Thus, without necessarily turning the cards over, one can simply look at the bottom and see what other designation is available. Should that other letter be needed in order to make a word, then the card can be inverted. However, using only one edge of the card, one can see not only the actual designation of the card, but the other possible designation if the card would be inverted.

Figure 5:
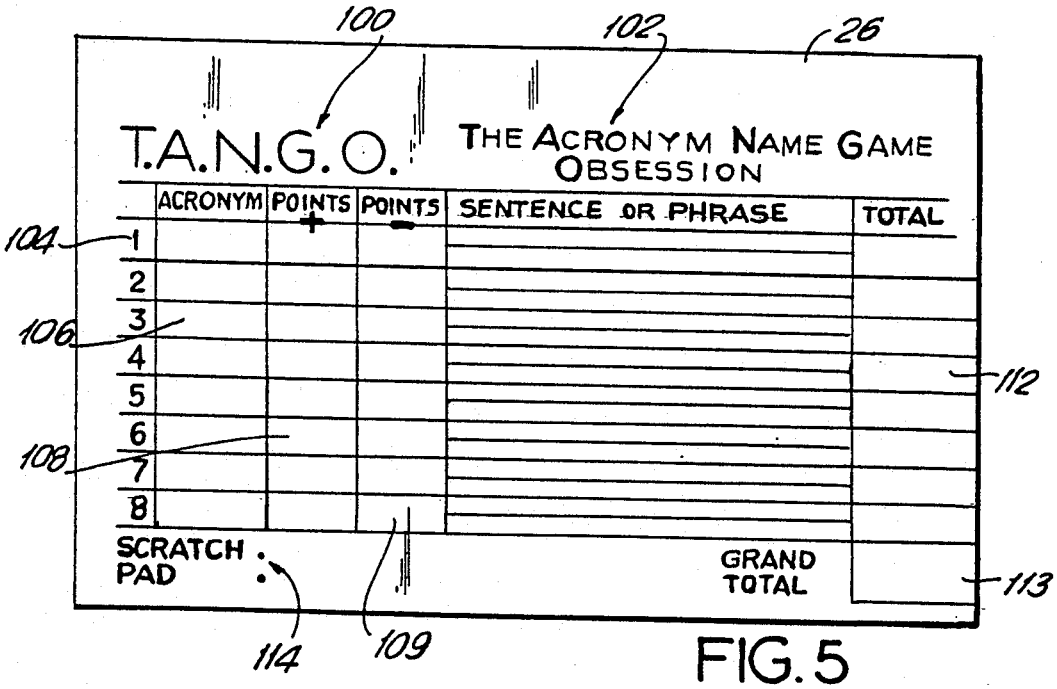
FIG. 5 is a front view of a scoring sheet for use in connection with the game of the present invention.

FIG. 5 shows a particular score sheet 26. At the upper edge there is provided the name of the game which in this case is "T.A.N.G.O." shown at 100. The word itself represents an acronym of the full name of the game written out as "The Acronym Name Game Obsession", shown at 102.

The first column 104 shows a sequence of numbers representing the number of rounds in the game. The second column 106 provides room for the particular word that is formed by the player and Will be used as an acronym. The next column 109 provides room for the points provided by the particular word formed by the group of cards put together. A separate column 109 is used to subtract points for cards not used. There is then provided room 110 for writing the full sentence or phrase made up by the player using the word written in column 106 as an acronym. The final column 112 is for the total points with a space 113 used for the grand total. Forming a sentence using the word as an acronym will increase the point value, as will hereinafter be explained in connection with the game rules. A room on the bottom 114 is provided for use as a scratch pad to write down words, sentences, or the like, as to an aid during the course of the game.

Figure 6:
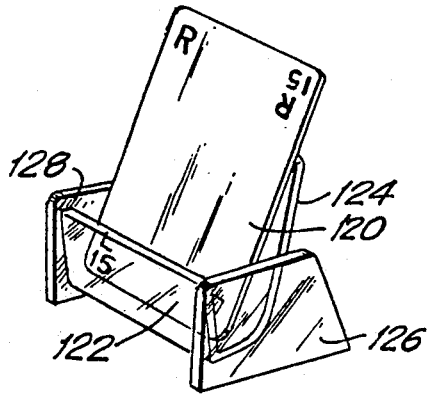
FIG. 6 is a perspective view of a card holder for use with the used cards in accordance with the rules of the present game.

FIG. 6 shows a perspective view of a card holder which can retain the cards after they have been used.

The card holder can be made of plastic, or the like. It includes a substantially U-shaped member 120 having a short front leg 122 and a large back leg 124. A pair of opposing side walls 126, 128 serve to retain the cards in place and also provide for the base on Which the device can sit.

The particular set of cards can be utilized to form a game wherein particular cards are selected and those cards that are selected utilized to form words. The cards can be oriented in either of their two invertible positions to form the words. Whichever way the particular card is held, the large letter in the upper left hand corner is the one that is utilized to form the word. Such letters are clearly visible providing large, clear, clean, unobstructive words no matter which end of the card is up. These letters are totally separated from the information corner in the lower part of the cards, depending upon the position in which the card is held.

In addition to utilizing the cards as a simple word game, it can also be used as an acronym game. In such acronym game, after the word is formed, the player must form a complete sentence using the word as an acronym. The game rewards players with the most imagination and word skills and through reward, also helps to develop and hone those skills in players who have never applied their latent potential that the expanded use of their own native tongue can provide. The game provides engrossing entertainment that is also an educational wellspring that expands the minds of each participant, in parting useful and valuable new mental resources that they may never have realized could be so easily tapped. Of equal importance, however, is the lack of complication, and the ease of learning to play which keeps the fun and excitement of the game.

A typically set of game rules are as follows:

1. T.A.N.G.O. can be played by 2, 3, 4 or more players. However, it plays most efficiently when limited to a maximum of four. It can also be played solo.
2. The deck of T.A.N.G.O. cards is shuffled and each player cuts to a card to determine the "starter". The one who draws the highest number starts the game. He divides the deck into three piles. Each player selects five cards at random. The starting player also puts one card taken at random from the top of any pile, face-up in the "Hot Card" zone. (See Game Set-up Instructions).
3. Beginning with the first player, and working clockwise around the table, each player tries to spell a word with his cards. Instead of "fanning" the cards a in conventional card play, by holding the cards vertically and spreading them apart evenly from top to bottom for a fraction of an inch from left to right, not only are the letters seen in the upper left hand corner of the cards, but looking at the bottom, the letters in the hidden corners are revealed. If a desired letter is needed but hidden, the card is simply reversed (turned upside down) and it has automatically replaced the unwanted letter.
4. A "round" of play is completed when all players have each created and entered a word and a phrase or sentence, and recorded the score. The finished word cards are placed in the holder and are out of the game. Any player failing to create a word with his cards, or having done so, a sentence or phrase using the letters of the word (even if it is not acronymic), loses his turn in the round. The use of any cards he may have drawn are forfeited, and are put face-up in the "hot card zone" on the master game pad.
5. Only one word may be formed with any hand of cards. Any excess cards are put face up in the "Hot Card" zone. The player must deduct the value of the excess cards from his score. Pluralization of words is O.K. Example: "Hotdogs" is not O.K. because it is only used as a double word "Hot Dogs", but "Milestone" is O.K. because it is commonly used in the singular as well as "Mile Stone".
6. No word or name may consist of less than three letters, but any single word greater than three letters may be played.
7. Famous or recognized names may be used in place of words, even if not found in the dictionary, but agreed to as acceptable by fellow players. The names can include political, military, historical, show business, scientific, artistic, or mythological identities. This may include well known literary characters or even "comic book" names. However, only a single name designation such as "Scrooge" may be used. Thus, Caesar is acceptable. Julius Caesar is not. Neither is Julius. If challenged the player must place the name used in it's historical or known context. To avoid argument, the rule excludes ANY name that is not KNOWN to be commonly used in the singular. Therefore, Napoleon Bonaparte may be used either as Napoleon or as Bonaparte since BOTH names are often used singularly to describe the Emperor of France.
8. In addition to words found in the dictionary, if players agree, commonly known and accepted famous names and acronyms as well as slang words can be used to play T.A.N.G.O. However, all players must also agree that when a slang word is claimed, it is legitimate, and not "made up" by the player. In case of dispute, reference must be proven by a dictionary of slang or if not available, by cutting to a high card to settle the matter.
9. A player who spells T.A.N.G.O. automatically doubles the point value of the cards used to make the word. If the acronym represented by the Trademark T.A.N.G.O.: "The Acronym Name Game Obsession" is used, then the double point value may NOT be re-doubled. If a different acronym for T.A.N.G.O. is devised, (One that describes the dance for example), then the double score will again re-double. If the sentence does NOT relate to the word but does not repeat the trademark acronym the double score stands, but does NOT re-double.
10. No acronym may use the same word that it represents in the descriptive sentence or phrase. Example: G.U.N.S. - "Gangsters Usually Need Sidearms" is O.K., but Guns Unloaded Never Shoot" is unacceptable because the acronym is GUNS!
11. When a player assembles his cards to make a word, he may decide to take a chance and draw additional cards. He can call the number of cards he wishes to draw, and must take them at random, in any order from the top of any of the three face down piles. If he draws cards he cannot use, he is "stuck" with them and must eventually put them on the "Hot Card" pile and deduct the value from his score. Each player also has the option to draw a face-up "Hot Card" from the "Hot Card" zone. But when placing a unuseable card on the "Hot Card" pile, he also takes the risk that it may be just the card that is needed by a competitor, and thus he is giving away valuable "points", while also losing points himself.

12. When a word is assembled, the player prints that word in the first box on his form sheet. He then adds all of the numbers in the lower left corners of the cards he is holding, and writes the combined value in the second box. After recording this information, he stores the no-longer needed hand of cards in the card holder.

13. There are five "wild" cards in the deck with "0" (zero) value. These cards are different from all the rest, in that they have a vowel at one end, and a blank at the other. If the vowel is not used to make a word, the blank area can be used to represent any letter of the alphabet the player holding the card wants it to be. While possessing no point value in itself, a "wild" card is invaluable when needed to make useful letter combinations, especially when a player finds himself "stuck" with extra cards.

14. When all players have finished their words, the timer is set and they must create a sentence which they write in the space provided in the third box. While no time limit is set for making a word, a time limit is established for making the sentence or phrase. When the timer sounds, or otherwise indicates the time is up, all players who have finished their sentences, will record the total value in the fourth box. They then each take turns announcing the word they made and reading their sentence. At this time, challenges may be made, and if any player demands to see the hand of cards, the challenged player must remove it from the holder and show it on demand.

15. The rules for rating and scoring a T.A.N.G.O. sentence is as follows: The sentence or phrase must be in good english. If it does not relate to the word, then the value of the word is transferred to the total box, and that is the score for that players "hand". If the sentence DOES relate to the word, then the total is double the value of the word. However, "qualifiers" may be used, and if so, then the sentence value does NOT double even if it relates to the word. "Qualifiers" are the use of lower-case words such as "and"; "a"; "the"; "in"; "of" and "to", which are added to make a proper sentence although the player does NOT have a card for the "qualifier" word, but has added it to his sentence to prevent it from being disqualified, causing him to lose the entire "round". If a player makes a word, but has NOT completed a sentence when the time is up he loses all and gets NO point value for that round. At the end of the game which ends when all of the cards are taken up and no more can be drawn, the players add up all of the points in the total boxes on their score sheet to arrive at a grand total. The player with the highest Grand Total wins. In the event of a score tie, the matter can be resolved by a rematch of one round to determine the final winner, or it can be settled more quickly and simply, by draw for the highest number card.

16. As the game draws to a conclusion, as long as three or more cards are on the board, they must be drawn. This includes the cards in the "Hot Card" zone. When down to the last few cards face-down cards, or if only the "Hot Cards" are left, the rule is to take the "Hot Cards", shuffle them, deal them into three piles, turn one card up on the "Hot Card" zone, and continue until no more than two cards or none, are left over.

When utilizing the game as an acronym game, as heretofore described, it is necessary that the game come up with words that can be useful in forming words which can be acronyms for use in describing a sentence. Particular combinations of letters have been found to be most appropriate for such use as an acronym game. In such combination, each letter combination is unique so that no two cards are identical. A deck of 82 cards has been found to be particularly significant in connection with use as an acronym game. The deck of cards consist of nine groups of card values with the values ranging from those of the "zero card value" and increasing by increments of five to reach a total maximum value of forty points. The points are based on the level of difficulty of use of the card to make a word.

The particular combination of the 82 cards in the deck of playing cards is as follows:

| GROUP | QUANTITY | LETTER COMBINATION | CARD VALUE |
|---|---|---|---|
| 1. | 5 | A/BLANK; E/BLANK; I/BLANK; O/BLANK; U/BLANK | 0 |
| 2. | 10 | O/I; U/O; E/A; A/I; U/I; A/O; I/E; O/E; E/U; A/U | 5 |
| 3. | 35 | D/A; S/O; T/I; L/O; N/U; U/T; B/E; Y/O; P/U; L/E; C/I; A/R; M/O; T/A; A/F; N/O; S/E; L/I; N/E; G/I; S/I; S/U; O/R; L/U; A/L; E/H; R/I; R/E; S/A; R/U; N/I; E/T; A/N; T/O; W/U | 10 |
| 4. | 10 | T/M; S/M; T/R; R/N; S/L; R/S; T/S; M/L; N/S; L/R | 15 |
| 5. | 10 | C/P; H/P; M/P; M/C; D/C; P/D; D/M; H/C; M/H; D/H | 20 |
| 6. | 5 | U/K; E/Z; A/Q; I/V; O/J | 25 |
| 7. | 5 | B/W; Y/F; W/Y; G/F; B/G | 30 |
| 8. | 1 | K/V | 35 |
| 9. | 1 | Z/X | 40 |

Although the above combination has been found uniquely beneficial in connection with use as an acronym game, a different combination may be desireable if the deck of playing cards is utilized only as a word game in the formation of words where the words need not be thereafter used as acronyms for creating a sentence. It should be appreciated, that other combinations of these cards into a deck is possible depending upon the purpose of use and the particular rules of the game devised.

There has been disclosed heretofore the best embodiment of the invention presently contemplated. However, it is to be understood that various changes and modifications may be made thereto without departing from the spirit of the invention.

What is claimed is:

1. A method of playing a word game utilizing a deck of playing cards, with each card being invertible and having different letter designations in two diagonally positioned corners, each letter designation being associated with each of two inverted positions of the card, an information section for advising in each position of the card the letter designation in the inverted position, and a point value for the card provided in said information section, the method comprising the steps of:

(a) selecting a plurality of the cards by an individual;

(b) arranging the cards by the individual to form a word from the letter designations of the cards and using said information sections so that each card can be selectively positioned in either of the two inverted positions thereof in forming such word even if a group of cards are placed in a fanned position, and (c) totalling the point value of the cards utilized in forming the word.

2. A method as in claim 1, and further comprising the steps of discarding the selected cards which are not utilized in forming the word and subtracting from the totaled point value of the cards discarded.

3. A method as in claim 1, and further comprising the steps of forming a sentence utilizing the word formed as an acronym for the words in the sentence.

4. A method as in claim 3, and further comprising the steps of doubling the point value of the totaled point value for the word.

5. A word game comprising a deck comprising:

a plurality of playing cards, the playing cards representing letters and having point values, a central playing surface for receiving piles of the playing cards for use by the players, individual playing surfaces for retaining the playing cards in use by the individual players, individual card storage holders for storing the cards used by the individual players, and scoring sheets for scoring the point value of words formed by groups of the playing cards, said playing cards being invertible and each having a letter designation in each of two diagonally opposite corners of the card and a letter designation being different in an upper left hand corner in each of two inverted positions of the card, an information section in each of two other diagonally opposite corners of the card for advising in each position of the card the letter designation in the inverted position of the card, said information section including an information letter corresponding to the letter designation being advised on, and a point value designation located adjacent to each information letter whereby each card can be selectively positioned in either of the two inverted positions thereof to form a word from the letter designations of the cards used by an individual player even if the cards are placed in a fanned position.

6. A word game as in claim 5, wherein the information letters are in the upper right hand corner of each card in each of two inverted positions, and wherein the information letters are upside down with respect to letters of the letter designations.

7. A word game as in claim 6, wherein the playing card is substantially rectangular in shape, having two long sides and two short sides, and wherein each letter designation and the information letter therefor are on the same short side of the card.

8. A word game as in claim 5, wherein said central playing surface comprises areas for a plurality of piles of unused cards and an area for a pile of discarded cards.

9. A word game as in claim 5, and further comprising a timing device.

* * * * *